US005678264A

United States Patent [19]

Walker

[11] Patent Number: 5,678,264

[45] Date of Patent: Oct. 21, 1997

[54] RECLINER

[75] Inventor: Peter David Walker, Clwyd, Great Britain

[73] Assignee: Comfort & Care Limited, Great Britain

[21] Appl. No.: 530,344

[22] PCT Filed: Mar. 21, 1994

[86] PCT No.: PCT/GB94/00574

§ 371 Date: Dec. 18, 1995

§ 102(e) Date: Dec. 18, 1995

[87] PCT Pub. No.: WO94/23617

PCT Pub. Date: Oct. 27, 1994

[30] Foreign Application Priority Data

Apr. 8, 1993 [GB] United Kingdom ..... 9307369

[51] Int. Cl.[6] ..... A47C 17/16

[52] U.S. Cl. ..... 5/613; 5/617; 297/354.13

[58] Field of Search ..... 297/354.13, 343; 5/613, 617, 618

[56] References Cited

U.S. PATENT DOCUMENTS

| | | | |
|---|---|---|---|
| 3,261,639 | 7/1966 | Phillips | 5/618 X |
| 3,289,222 | 12/1966 | Nielsen | 5/617 |
| 3,854,154 | 12/1974 | Degen | 5/613 X |
| 5,315,726 | 5/1994 | Borenstein | 5/618 |
| 5,404,604 | 4/1995 | Has et al. | 5/617 |

FOREIGN PATENT DOCUMENTS

| | | |
|---|---|---|
| 1247813 | 10/1960 | France . |

*Primary Examiner*—Peter R. Brown
*Attorney, Agent, or Firm*—Charles J. Brown

[57] ABSTRACT

There is disclosed a recliner having back and seat portions connected by a hinge and supported on a base for progressive relative adjustment between a bed configuration in which back and seat portions are substantially aligned and horizontal and a chair configuration in which the back is raised and the hinge drops during the progressive adjustment so as to maintain the centre of gravity of recliner and occupant substantially at constant height whereby to facilitate adjustment by an occupant, the back being pivoted on the base at a pivot position spaced from the hinge, the pivot position being adjustable towards and away from the hinge to adjust the recliner to accomodate occupants of different body weights.

1 Claim, 2 Drawing Sheets

RECLINER

This invention concerns a counterpoise recliner.

Known such recliners, for example, garden chairs, sun loungers and the like, require considerable shifting of an occupants body weight before the position of the recliner may be adjusted.

In articulated beds, for example, as used in nursing homes for infirm patients who are unable to lift themselves from a lying to a sitting position, this problem is overcome by having the moveable parts of the bed power controlled, for example, by electric motors. Although saving on nursing staff suffering from back injuries due to strenuous lifting operations, the powered beds have a number of drawbacks. Firstly, the beds are expensive to purchase and operate. They require maintianance of the electrical parts, and if those parts should fail, reduce the bed to a normal 'static' bed wherein the nursing staff have to lift patients manually to change their position. Also hospitals are unlikely to use such electrically powered beds in the same vicinity as oxygen cylinders and the like where they are likely to be a hazard.

The present invention provides a recliner which addresses these problems.

According to the present invention there is provided a recliner having back and seat portions connected by a hinge and supported on a base for progressive relative adjustment between a bed configuration in which back and seat portions are substantially aligned and horizontal and a chair configuration in which the back is raised and the hinge drops during the progressive adjustment so as to maintain the centre of gravity of recliner and occupant substantially at constant height whereby to facilitate adjustment by an occupant.

The recliner may comprise a locking member locking the recliner at a desired position.

The locking member may be pivotally mounted on the base and may comprise a strut telescopically connecting the hinge and having a plurality of stops releasably engageable with a sprung pin.

The locking member may comprise a handle located on the recliner and adjacent the hinge which operates the sprung pin.

The recliner may comprise a leg rest portion which may be hingedly connected to the seat portion.

The leg rest portion my be supported by a double link assembly mounted to the base.

The double link assembly may comprise a parallel link assembly, or at least one link of the double link assembly may be adjustable in height. Such a link may comprise a series of notches and pegs for adjusting the height thereof.

The back of the recliner may be pivoted on the base at a pivot position spaced from the hinge.

The pivot position may be moveable towards and away from the hinge, such movement being capable of accomodating different body weights of occupant to maintain the centre of gravity aforementioned at substantially constant height during adjustment of the recliner.

The recliner may also comprise a sprung member pivotally connecting the recliner and base so as to provide damping or assistance to the movement of the recliner.

The invention will be further apparent from the following description with reference to the several figures of the accompanying drawings, which show, by way of example only, one form of the recliner embodying same.

Figure 1:
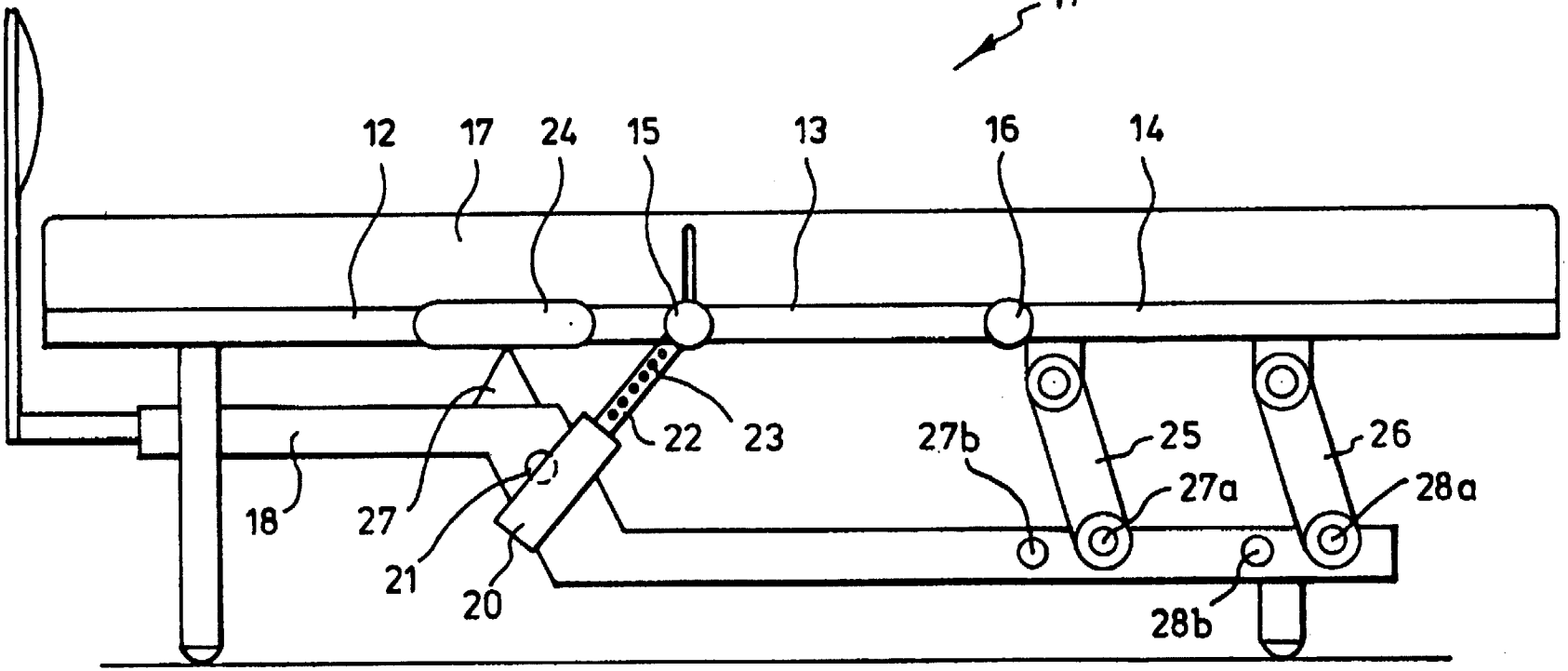
FIG. 1 shows the recliner in a 'bed' position.
Figure 2:
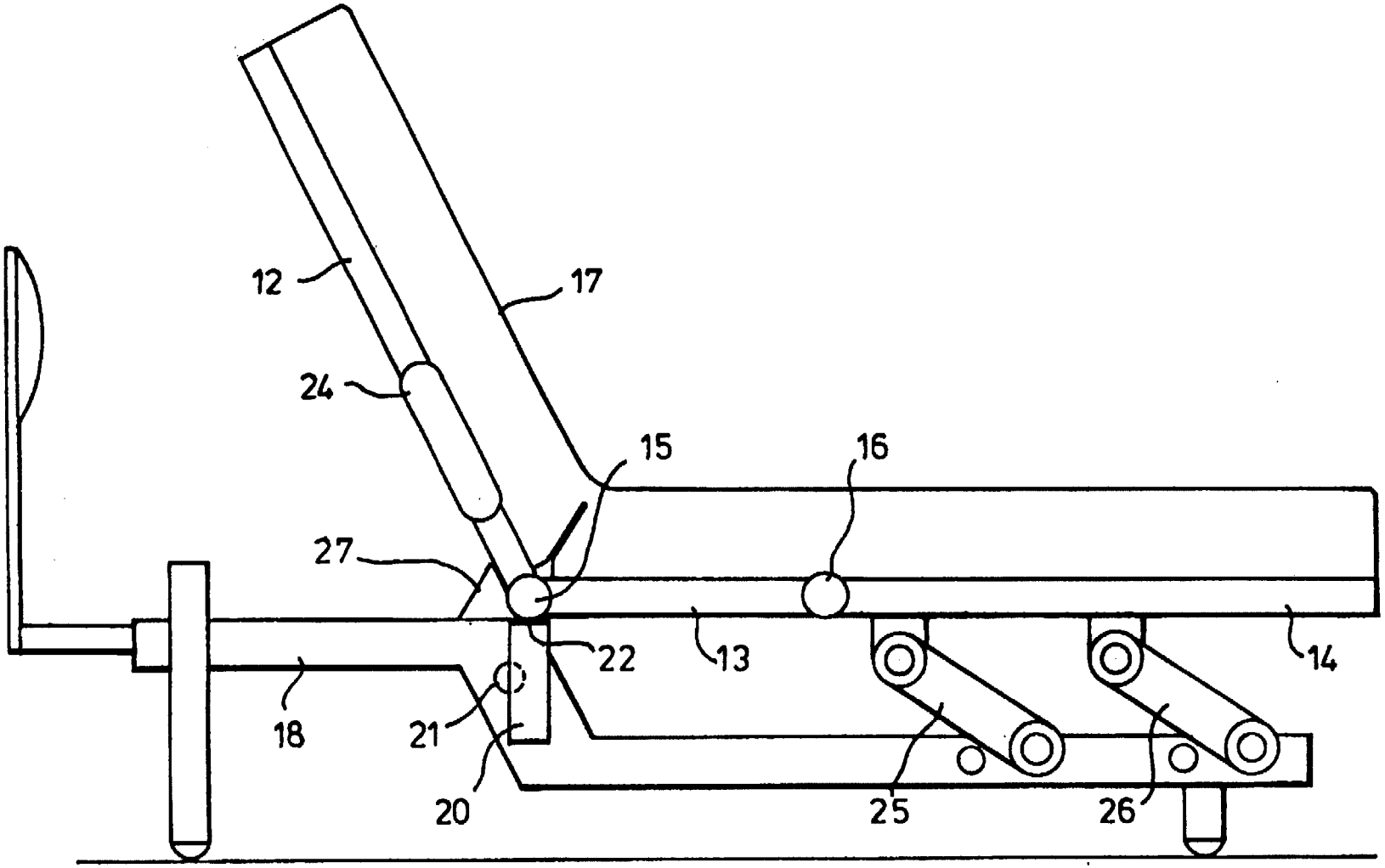
FIG. 2 shows the recliner in a 'chair' position.

Referring now to the drawings, it will be seen that the recliner 11 comprises a back portion 12, seat portion 13 with a leg rest portion 14. The back and seat portions 12, 13 are connected by a hinge 15. A two part hinged mattress 17 covers the recliner 11. Portions 12, 13 and 14 are supported on a stationary base 18 for progressive relative adjustment between a bed configuration in which the back 12, and seat and leg rest portions 13, 14 are substantially aligned and horizontal, as shown in FIG. 1, and a chair configuration in which the back 12 is raised, as shown in FIG. 2, and the hinge 15 drops during the progressive adjustment so as to maintain the centre of gravity of recliner and occupant substantially at constant height whereby to facilitate adjustment by an occupant.

It will be appreciated that the centre of gravity depend on several factors involving the weight of the occupant and the precise disposition of the occupant and the recliner. By maintaining this centre of gravity substantially at constant height is meant that the occupant should not have to exert any undue force to change the recliner configuration as a result of having to lift the combined weight of his body and the adjustable portions whether raising or lowering the back 12. Differences between the body weights of different people are addressed below.

A locking member 20 is mounted on the base 18 by a pivot 21 to lock the recliner in a desired position. The locking member 20 comprises a strut 22 telescopically connecting hinge 15 and having a plurality of stops 23 releasably engageable with a sprung pin (not shown). As illustrated, the stops are apertures in the strut 22.

A handle 24 located on the recliner and adjacent the hinge 15 operates the sprung pin via a bowden cable arrangement, not illustrated.

The leg rest portion 14 is supported by two parallel double link assemblies 25, 26 mounted to the base 18. The lower pivotal position of the swing link assemblies 25, 26 is adjustable between positions **27*a*, 27*b* and 28*a*, 28*b*** respectively allowing adjustment of the frame for optimum performance.

The back 12 of the recliner 11 is pivoted on the base 18 at a pivot position 27 spaced from the hinge 15.

The pivot position 27 is moveable towards and away from the hinge 15, such movement being capable of accommodating different body weights of occupant to maintain the centre of gravity aforementioned at substantially constant height during adjustment of the recliner. The optimum position of the pivot will normally be found by trial and error.

It will be appreciated that it is not intended to limit the invention to the above example only, many variations, such as might readily occur to one skilled in the art being possible without departing from the scope thereof as defined by the appended claims.

For example, at least one link of the double link assembly 26 may be adjustable in height. Such a link may comprise a series of notches and pegs for adjusting the height thereof such that a patient's feet may be elevated.

The recliner may also comprise a sprung member or a gas strut pivotally connecting the back or other part of the recliner and base so as to provide damping or assistance to the movement of the recliner.

I claim:

1. In a recliner having back and seat portions connected by a hinge and supported on a base for progressive relative adjustment between a bed configuration in which the back and seat portions are substantially aligned and a chair configuration in which the back is raised, the hinge dropping as the back portion moves from the bed to the chair configuration, the improvement which comprises a) fulcrum member on the base slidably engaging the back portion and about which the back portion pivots as it is moved between the bed and chair configurations, b) the fulcrum member being spaced from the hinge and being movable to selected positions on the base member toward and away from the hinge, and c) a locking member pivotally mounted on the base and including a strut telescopically connecting the hinge to the base and adjustable to selected fixed telescopic positions to hold the hinge in selected fixed positions.

* * * * *